United States Patent [19]

Benjamin

[11] 3,965,222

[45] June 22, 1976

[54] CARBURETION SYSTEM

[75] Inventor: Benjamin C. Benjamin, Flint, Mich.

[73] Assignee: Schmelzer Corporation, Durand, Mich.

[22] Filed: Sept. 3, 1974

[21] Appl. No.: 502,527

[52] U.S. Cl. ..... 261/39 B; 123/119 F; 236/87; 236/101 E

[51] Int. Cl.[2] ..... F02M 1/10

[58] Field of Search ..... 261/39 B, 39 A; 123/119 F; 236/101 E, 87

[56] References Cited

UNITED STATES PATENTS

| | | | |
|---|---|---|---|
| 2,325,372 | 7/1943 | Coffey | 261/39 B |
| 2,818,239 | 12/1957 | Eickmeier et al. | 261/39 B |
| 2,942,596 | 6/1960 | Carlson | 123/119 F |
| 3,058,727 | 10/1962 | Lucas | 261/39 B |
| 3,190,274 | 6/1965 | Manning, Jr. et al. | 261/39 B |
| 3,259,377 | 7/1966 | Braun et al. | 261/39 B |
| 3,263,661 | 8/1966 | Marsee | 261/39 B |
| 3,450,342 | 6/1969 | Arledge, Jr. | 236/101 E |
| 3,486,742 | 12/1969 | Szwargulski | 261/39 B |
| 3,726,512 | 4/1973 | Herwig et al. | 261/39 B |
| 3,734,403 | 5/1973 | Eshelman et al. | 236/101 E |
| 3,790,077 | 2/1974 | Wisyanski et al. | 236/87 |
| 3,800,762 | 4/1974 | McCullough | 261/39 B |
| 3,804,326 | 4/1974 | McIntire | 236/87 |
| 3,872,189 | 3/1975 | Brown et al. | 261/39 A |

*Primary Examiner*—Tim R. Miles
*Attorney, Agent, or Firm*—Hugh L. Fisher; Irvin L. Groh

[57] ABSTRACT

A carburetion system wherein the choke opening is modulated in accordance with the ambient temperatures. A choke modulator mounted in the carburetion system's air cleaner employs a temperature sensitive provision to vary air flow to the choke thermostat and accordingly, varies the temperature at which the choke operates.

9 Claims, 6 Drawing Figures

CARBURETION SYSTEM

The invention relates to improvements in carburetion systems.

Carburetion systems wherein the choke opens too soon results in engine stalling. On the other hand if the choke remains closed or partially closed too long, the air-fuel mixture is too rich resulting in excessive undesired emissions, greater fuel consumption and even engine flooding.

With the foregoing in mind, a new and different carburetion system is provided wherein the carburetor choke opening is modulated in accordance with ambient temperatures to obtain improved engine operation.

Another objective is the provision of a carburetion system wherein the supply of air for controlling choke opening is filtered and its temperature sensed for control purposes.

Still another objective is to provide a carburetion system with a choke modulator that is installed upstream of a choke thermostat and controls air flow thereto so as to delay choke opening until a certain ambient termperature is attained.

The foregoing and other objects and advantages of the invention will become apparent from the following description and the accompanying drawings in which.

Figure 1:
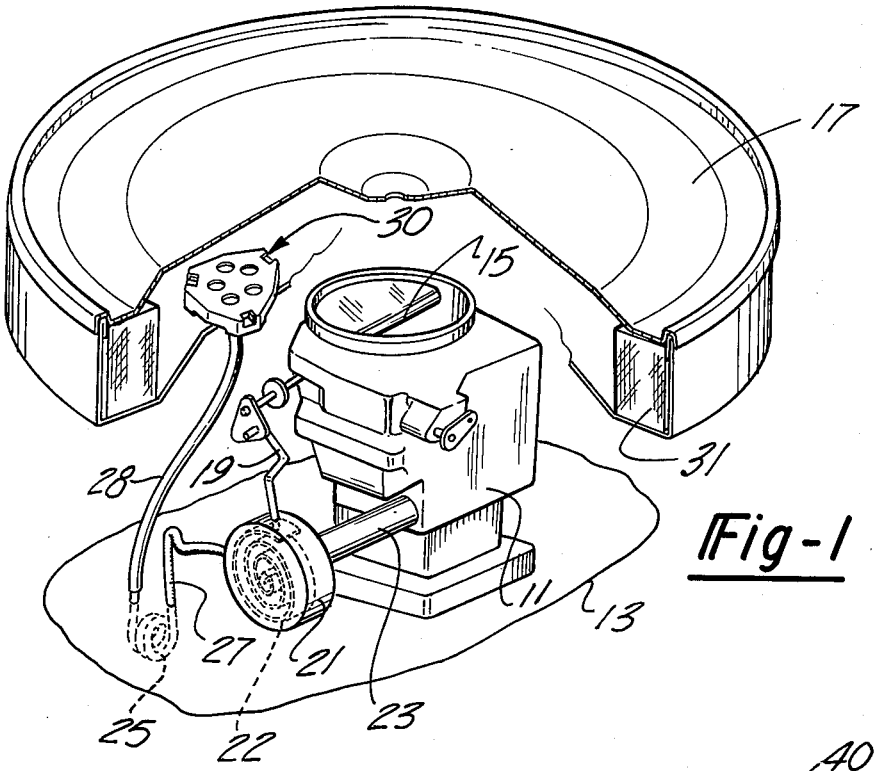
FIG. 1 is a perspective view, with parts broken away, of a carburetor system incorporating the principles of the invention.
Figure 2:
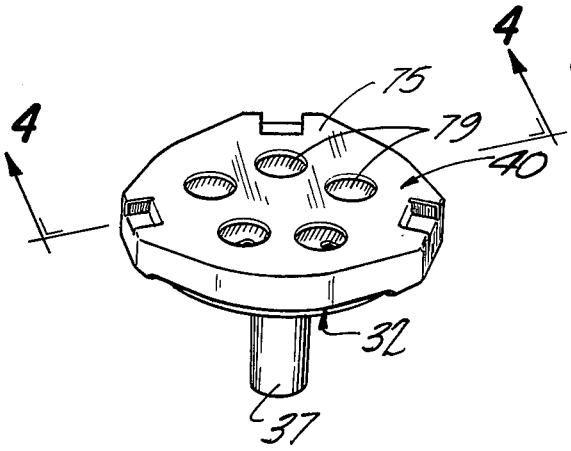
FIG. 2 is an enlarged perspective view of a choke modulator employed in the FIG. 1 system.

As illustrated in FIG. 1, an automotive carburetion system including a carburetor 11 is shown on the usual intake manifold of an automotive engine 13. The carburetor 11 has a choke valve 15 at its air intake disposed within a well known air cleaner assembly 17. The choke valve 15 is actuated by a crank assembly 19 connected to a thermostat 21 which includes a conventional bimetal thermostatic coil 22 that when heated operates in the usual way through the crank assembly 19 to open the choke valve 15. A vacuum source 23 which can be the engine intake manifold, connects the thermostat 21 to the carburetor 11 providing a negative pressure at the thermostat interior. A heat exchanger 25 which is preferably mounted on the engine 13 so as to sense exhaust manifold temperatures is connected to the thermostat 21 by a conduit 27. The heat exchanger 25 is in turn connected by a conduit 28 to a choke modulator 30. Temperature changes in the air sucked into the interior of the thermostat 21 by way of the choke modulator 30 and the conduit 28 through the conduit 27 vary the tension in the bimetal coil 22 as just explained. This turns the crank assembly 19 which rotates the choke valve 15 between its open and closed positions so as to vary the proportion of air admitted to the carburetor 11 and thereby the richness of the fuel mixture for cold starts.

The choke modulator 30 functions to control the rate of air flow to the thermostat 21. For reasons to become apparent, the choke modulator 30 is disposed on the clean air side of the air cleaner 17 upstream of the carburetor air intake to the choke valve 15 and within the area defined by a suitable filter element 31. As viewed in FIG. 3, the choke modulator comprises a housing 32, typically a zinc die casting, having a flat bottom 33 defined by upwardly extending side wall 35 and a downwardly depending neck 37.

Figure 4:
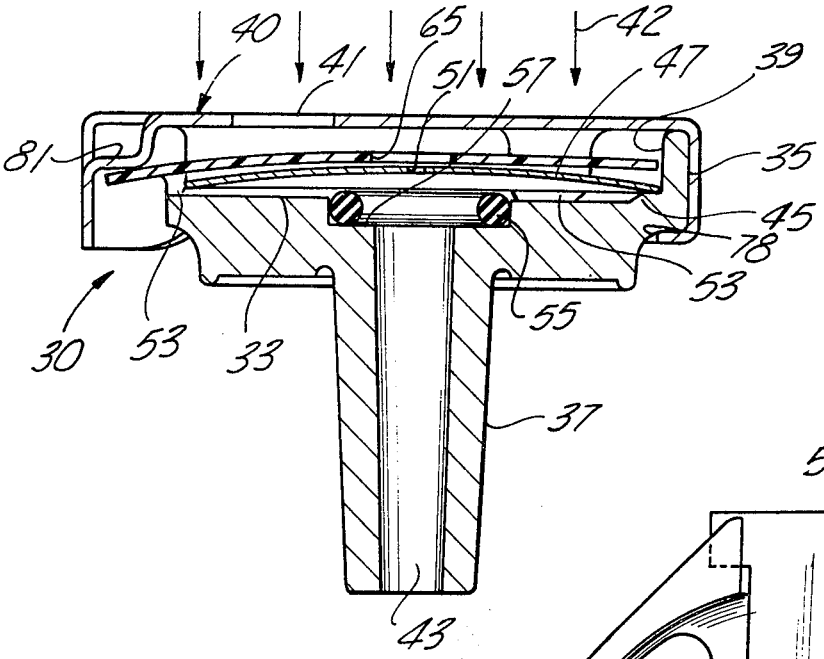
FIG. 4 is a sectional view of the choke modulator taken in the direction of arrows 4—4 in FIG. 2.

This housing 32, as seen in FIG. 4, defines a chamber 39, which receives air by way of a cap 40. This cap 40 has air inlet passages, portions or openings 41 through which air flows in the direction of arrows 42 in FIG. 4, and serve as what is referred to as primary air intake passages 41. The neck 37 of the housing 32 provides for an air exit or outlet passage 43 for this incoming air. The housing 32 has a narrow pilot ledge 45 circumferentially extending around the interior junction of the side wall 35 and the bottom 33 of the housing 32 for locating a temperature responsive element in the form of a circular bimetallic disc 47.

This bimetallic disc serves a temperature responsive function and has an aperture 51 of a diameter, which in the present embodiment, is small with respect to the diameter of the air outlet passage 43 in the neck 37. The aperture 51 always permits a constant restricted flow of air from the primary intake portion of the chamber 39 to the air outlet passage 43. In addition to the primary air inlet passages 41 the side wall 35 of the housing 32 is provided with secondary air inlet openings or passages 53 disposed between the disc 47 and the bottom 33 of the housing 32 and extending through the pilot ledge 45 as seen in FIG. 4. Three of such passages 53 are shown for exemplary purposes. As those skilled in the art will appreciate, the number and their size can be varied to meet the requirements of each application.

Also disposed between the disc 47 and the bottom 33 of the housing 32 is a resilient compressible O-ring 55, typically made of silicon rubber. The O-ring 55 rests in a circular seat 57 provided in the bottom 33 of the housing 32. In the FIG. 1 embodiment, the inner diameter of the O-ring 55 is preferably at least as great as the diameter of the air outlet passage 43 and the depth of the O-ring 55 is at least slightly greater than the depth of the circular seat 57 in which it rests. As observed in FIG. 4, the centers of the O-ring 55 and the seat 57 are aligned with the aperture 51 in the disc 47 and the air outlet passage. 43. Therefore, since the disc 47 is formed of a suitable bimetal material so as to respond to changes in temperature over a predetermined range, the disc 47 will reversibly flex from a concave to a substantially convex position. For the purposes herein, the term concave refers to the configuration of disc 47 when it is out of engagement with O-ring 55 and convex refers to the configuration when disc 47 flexes into sealing engagement with the O-ring 55.

In the broken line convex position in FIG. 4 with the disc 47 in sealing engagement with the O-ring 55, it can be seen that the O-ring 55 defines a so called restricted air flow path through the constant size air inlet aperture 51 to the air outlet passage 43, sealing off the flow of air from the secondary air intake passages 53 to the air outlet passage 43.

Thus, it can be seen that when the disc 47 is in the maximum convex position a minimum fixed rate of air flow, determined by the size of the aperture 51 in the disc 47, will be permitted to pass to the air outlet passage 43. Conversely, when the disc 47 is in the maximum concave position, a maximum rate of air flow from both the primary and secondary air inlet passages 40 and 53 will be permitted to pass through the air outlet passage 43 the secondary air being free to flow radially inwardly through passages 53 which extend at the underside of the circumferential edge of the disc 47 through the pilot ledge 45.

While FIG. 4 illustrates maximum and minimum air flow conditions, the characteristics of the bimetallic disc 47 are such that the flexure from the concave to the convex positions is gradual. The disc 47 is designed to be in the maximum convex position when the air temperature is at the low end of a predetermined temperature range. Therefore, in cold temperature conditions, a minimal rate of air flow will be permitted through the air outlet passage 43 to the thermostat 21. Consequently, there will be a minimum amount of air passing through the heat exchanger 25 to be warmed thereby before being drawn by the intake manifold vacuum pressure into the thermostat interior. As a result the choke valve 15 will remain in its closed setting. As the air temperature rises over the predetermined range the disc 47 gradually flexes from the maximum convex position toward the concave position. At the upper end of the predetermined temperature range, the disc 47 gradually approaches a flat position beyond which it snaps into a fully concave position. During the gradual flexure from the convex to the flat position the rate of air flow from the secondary air intake passages 53 to the air outlet passage 43 gradually increases, thereby gradually increasing the amount of warm air that will be directed to the thermostat 21. When the disc 47 snaps to the full concave position a maximum rate of air flow to the thermostat 21 is achieved. Conversely, if the disc 47 is in the maximum convex position, as shown by the broken line in FIG. 4, a minimum rate of air flow is permitted to the thermostat 21. As the temperature drops below the upper end of the predetermined range, the disc 47 will gradually flex from the maximum concave configuration to the flat configuration thereby gradually decreasing the flow of air to the thermostat 21. When the flexure goes beyond the flat position the disc 47 will snap into the maximum convex position again sealing off the secondary air intake passages 53 and permitting only the primary air intake passages 40 to supply air through the aperture 51 to the thermostatic coil 22. Typically, a workable predetermined temperature range may be established at a range from 54° F in the maximum convex position to 67° F in the maximum concave position, but as those versed in the art will appreciate the selected range will vary depending on the characteristics of the engine 13 with which the modulator 30 is to be used.

Figure 3:
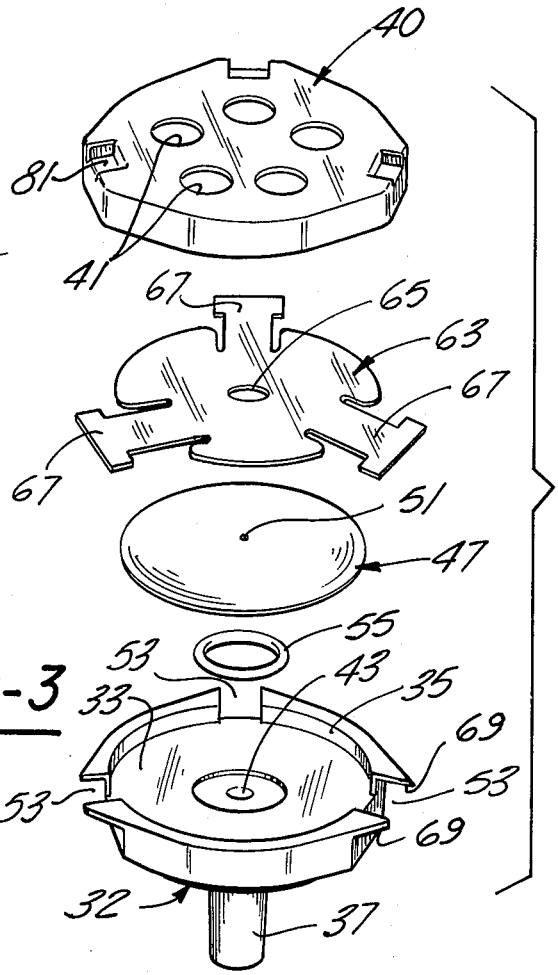
FIG. 3 is an exploded view of the FIG. 2 choke modulator.
Figure 5:
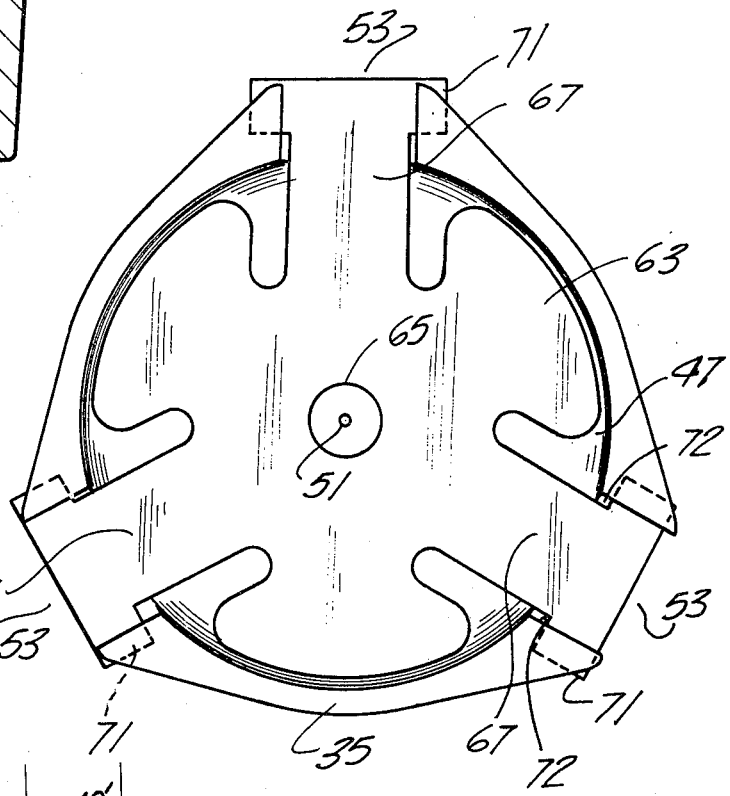
FIG. 5, is a top view of the FIG. 2 choke modulator with the cap removed.

The negative pressure applied to the disc 47 through the air outlet passage 43 tends to retain the disc 47 against the ledge 45 on which it rests. To secure the disc 47 in this position, however, a flat, flexible resilient member 63, typically of nylon plastic, is disposed adjacent the disc 47 on the side opposite the O-ring 55. The member 63, as is shown in FIGS. 3 and 5 is substantially circular, and is provided with an aperture 65 so as to not interfere with the flow of air through the aperture 51 in the disc 47. In addition, the member 63 is slotted to provide tabbed fingers 67. These fingers 67 are situated about the member 63 so as to coincide with the disposition of the secondary air inlet passages 53 in the side wall 35 of the housing 32. With the member 63 resting on the disc 47, the fingers 67 extend through the passages 53. Lugs 69 (FIG. 3) are provided on the outer surface of the side wall 35 at both sides of the secondary inlet passages 53. Tabs 71 on the fingers 67 are flexibly snapped beneath the lugs 69 as viewed in FIG. 5, pressing the member 63 against the disc 47 and securing it in place against the ledge 45. The fingers 67 extend through the secondary air inlet passages 53 to provide a slight space at 72 between the edge of the tabs 71 and the edge of the side wall 35 so that the member 63 does not interfere with the flexure of the disc 47 to the maximum concave position; i.e., it is free to move. It should also be noted that the member 63, in addition to securing the disc 47 in place on the ledge 45, provides a load on the disc 47 to control the hysteresis loop. This load serves to minimize the hysteresis effect of the disc 47; that is, the time lag between a decrease in temperature and the disc flexure toward the convex position.

Finally, a cap 40, illustrated in FIGS. 3 and 4, is provided to secure the O-ring 55, disc 47 and member 63 of the modulator 30 in their proper position. The cap 40 is of unitary structure, typically made of steel, having a top portion 75 and downwardly depending side walls 77, shaped to fit snugly over the open end of the housing 32. As explained, the openings 41 in the top portion 75 permit a free flow of air to the chamber 39. The outer extremity of the top portion 75 is punched, at points coinciding with the secondary air inlet passages 53 in the side walls 35 of the housing 32, to provide detents 81. The detents 81 prevent the tabs 71 of the retaining member 63 from snapping out of the lugs 69 on the housing 31. The side walls of the cap 40 are sufficiently long so that their edges may be pinched between the detents 81 and about a bottom flange 78 of the housing 32, as observed in FIGS. 4 and 6, thereby securing the cap 40 in place.

Figure 6:
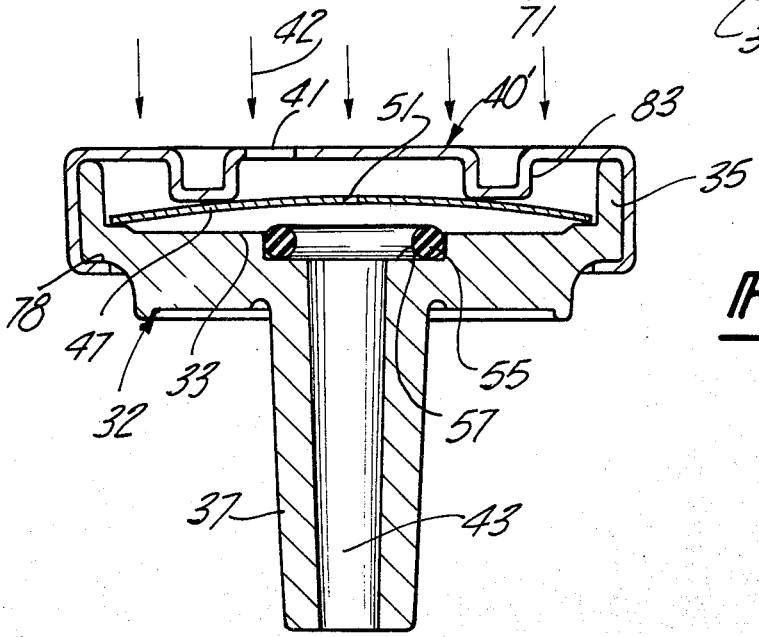
FIG. 6 is a sectional view of another embodiment of the FIG. 2 choke modulator.

FIG. 6 illustrates an alternate cap configuration which, when used in place of the cap 40, shown in FIG. 4, eliminates the need for the resilient retaining member 63. The modified cap 40' is similar to the cap 40 shown in FIG. 4 in all respects except that it is provided with a plurality of downwardly extending projections 83 that serve the function of the member 63. The depth of the projections 83 is such that they abut the disc 47 when the disc 47 is in the maximum concave configuration. The resultant load exerted on the disc 47 by the projections 83 fulfills both functions of the retaining member 63 in that it both retains the disc 47 in place on the ledge 45 and also minimizes the hypteresis effect.

The choke modulator 30 is suitably mounted in an opening on the clear air side of the air cleaner 17, as shown in FIG. 1; i.e., within the space within the air cleaner 17 defined by the filter element 31 and with the neck 37 of the housing 32 depending downwardly therefrom. Any suitable clamp and sealing device such as a gasket and tinnerman fastener (not shown) may be used to hold the housing 32 in place in the air cleaner assembly 17.

In operation, clean air is drawn through the choke modulator 30 at a rate determined by the ambient temperature through the air outlet passage 43, the conduit 28, the heat exchanger 25, the conduit 27 and to the interior of the thermostat 21 and then by way of the conduit 23 to the vacuum source. The quantity of air and its temperature influence the thermostatic bimetal coil 22 and in turn through the crank assembly 19 alter the setting of the choke valve 15 to afford the optimum choking at the existing environmental temperature. In cold temperatures the air flow is restricted and, hence, choke opening is delayed until the engine temperature has increased to that selected for the desired opening of the choke.

The embodiments of the invention in which an exclusive property or privilege is claimed are defined as follows:

1. In a carburetion system having a choke, the combination of an air cleaner assembly including a filter, an air temperature responsive choke thermostat for operating the choke, modulating means disposed in said air cleaner assembly and modulating the supply of filtered air to the choke thermostat in accordance with the ambient temperatures in said air cleaner assembly, a heat source for warming the filtered air, a vacuum source connected to the choke thermostat to cause filtered air to be drawn from the air cleaner through the modulating means and the heat source to the choke thermostat, said modulating means including an air inlet positioned in said air cleaner to receive filtered air from said air cleaner, an air outlet operatively connected to the heat source and a temperature responsive means operative in response to the temperature in said air cleaner to vary the quantity of filtered air transferred between the air inlet and the choke thermostat from a minimum to a maximum as temperature in said air cleaner increases to change the temperature response of the thermostat and accordingly the operation of the choke.

2. In a carburetion system having a choke, the combination of an responsive choke thermostat for operating the choke and means modulating the supply of air to the choke thermostat in accordance with the ambient temperatures so as to vary choke operation, said modulating means including a chamber having a primary air inlet, a secondary air inlet and an air outlet connected to the choke thermostat and temperature responsive means disposed in the chamber for varying the flow of air to the air outlet in response to the ambient temperature, the temperature responsive means having restricting means having an aperture therein for permitting plural positions in one of which a constant minimal flow of air from the primary air inlet to the air outlet is permitted and in another of which the restricting means being reversibly, gradually, flexibly responsive to temperature changes over a predetermined range, a variable flow of air from both the primary and said secondary air inlets to the air outlet is permitted.

3. In a carburetion system having a choke, the combination of an air responsive choke thermostat for operating the choke, means modulating the supply of air to the choke thermostat in accordance with the ambient temperatures so as to vary choke operation, a heat source connected between the modulating means and the choke thermostat, a vacuum source connected to the choke thermostat so as to cause air to be drawn through the modulating means and the heat source to the choke thermostat so as to change the temperature response thereof and accordingly the operation of the choke, said modulating means being arranged relative to the air cleaner assembly so as to supply variable quantities of filtered air to the choke thermostat, said modulating means including a chamber having a primary air inlet, a secondary air inlet and an air outlet connected to the heat source, and temperature responsive means positioned in the chamber and arranged to reversibly, gradually, flexibly change positions in response to changes in temperature over a predetermined range and thereby vary the flow of air from the primary and secondary air inlets to the air outlet, the temperature responsive means having an aperture therethrough permitting a constant minimal flow of air from said primary air inlet to the air outlet.

4. In a carburetion system having a choke, the combination of an air responsive choke thermostat for operating the choke and means modulating the supply of air to the choke thermostat in accordance with the ambient temperatures so as to vary choke operations, said modulating means including an integral housing having a side wall and a bottom, a bimetallic element temperature responsive reversibly, gradually, flexibly responsive to changes in temperature over a predetermined range disposed within said housing in spaced relation to said bottom and having an aperture therethrough, an air inlet in the walls between the element and the bottom, an air outlet passage in the bottom connected to the choke thermostat, and cap means covering the housing and having an air inlet therein, the element in response to temperature changes over the predetermined temperature range being operative to variably restrict the flow of air from the air inlets to the air outlet, whereby the rate of air flow to the choke thermostat varies as the air temperature varies over said predetermined range.

5. In a carburetion system having a choke thermostat, the combination of a choke modulator comprising an integral, cylindrical housing having side walls, a bottom, an outwardly extending rim about the upper end of the side walls and an interior circumferential ledge along the junction of the bottom and the side walls, a plurality of slots spaced about the housing and extending verically through the rim, side walls and ledge, a shallow seat centrally disposed in the bottom, an air inlet through the bottom and the seat, a compressible O-ring disposed on the seat and having an inner diameter at least as large as the diameter of the air outlet and a depth greater than the depth of the seat, a flexible bimetallic disc positioned on the ledge in face-to-face relationship with the bottom with the ring therebetween, the disc being responsive to temperature changes over a predetermined range to reversibly, gradually flex from a convex to a concave position as the air temperature varies over the range, an air inlet aperture through said disc aligned with the air outlet, the aperture being small in relation to said outlet, a flat flexible member adjacent the side of the disc opposite the bottom for preloading the disc, the member having a plurality of integrally extending fingers, one each of said fingers extending through one each of the slots, each of the fingers having an integral tab at its outer end extending beneath the rim, said tabs being cooperable with the rim to secure the member against the disc, the member having an aperture therethrough at least as large as and aligned with said air inlet aperture, a cap fixedly secured across the upper end of the housing, the cap having an air inlet therethrough and having a plurality of detents, one each of the detents extending downwardly into one each of the slots, and means causing a flow of air from the air outlet to the choke thermostat, the disc being responsive to changes in temperature over a predetermined range to reversibly flex from a convex to a concave position as the air temperature varies over the range, the disc being cooperable in the maximum convex configuration with the bottom to compress said O-ring therebetween to define a minimum constant closed air flow path from the air inlet aperture to the air outlet and the disc being flexibly cooperable with the O-ring over the predetermined range to define a variable air flow path from the plurality of slots and the cap air inlet to the air outlet, whereby the rate of air flow to the choke thermostat varies as the temperature varies over said predetermined range.

6. In a carburetion system having a choke thermostat, the combination of choke modulator comprising an integral, cylindrical housing having side walls, a bottom, an outwardly extending rim about the upper end of the side walls and an interior circumferential ledge along the junction of said bottom and said side walls, a plurality of slots spaced about said housing and extending vertically through the rim, side walls and ledge, a shallow, circular seat centrally disposed in the bottom, a compressible O-ring disposed on the seat and having an inner diameter at least as large as the diameter of said outlet passage and a depth greater than the depth of said seat, a flexible bimetallic disc positioned on the ledge in face-to-face relationship with the bottom with the ring therebetween, the disc being responsive to temperature change over a predetermined range to reversibly, gradually flex from a convex to a concave position as the air temperature varies over the range, an air inlet aperture through said disc aligned with said air outlet, the aperture being small in relation to said outlet passage; a cap fixedly secured across the upper end of the housing, the cap having an air inlet therethrough and having a downwardly extending projection for preloading the disc and means causing a flow of air from the air outlet to the choke thermostat, the disc being responsive to changes in temperature over a predetermined range to reversibly flex from a convex to a concave position as the air temperature varies over the range, the disc being cooperable in the maximum convex position with the bottom to compress said O-ring therebetween to define a minimum constant closed air flow path from the air inlet aperture to the air outlet and the disc being flexibly cooperable with said O-ring over the predetermined range to define a variable air flow path from the plurality of slots and the cap air inlet to the air outlet, whereby the rate of air flow to the choke thermostat varies as the temperature varies over the predetermined range.

7. In a carburetion system having a choke, the combination of an air responsive choke thermostat for operating the choke, means modulating the supply of air to the choke thermostat in accordance with the ambient temperatures so as to vary choke operation, a heat source connected between the modulating means and the choke thermostat, a vacuum source connected to the choke thermostat so as to cause air to be drawn through the modulating means and the heat source to the choke thermostat so as to change the temperature response thereof and accordingly the operation of the choke, said modulating means being arranged relative to the air cleaner assembly so as to supply variable quantities of filtered air to the choke thermostat, said modulating means including an integral cylindrical housing having side walls and a bottom, a bimetallic element disposed within said housing in spaced relation to said bottom and having an aperture therethrough, an air outlet disposed through the bottom and connected to the heat source, cap means covering the housing and having a primary air inlet therethrough, a secondary air inlet in the side walls between the element and said bottom, a compressible O-ring having an inner diameter at least as large as the diameter of the said air outlet, the said O-ring being disposed within said housing between the element and the bottom in alignment with said aperture and the air outlet and means preloading the bimetallic element, the bimetallic element being responsive to changes in temperature over a predetermined range to reversibly flex from a convex to a concave position as the air temperature varies over the range, the bimetallic element being cooperable in the maximum convex position with the bottom to compress the O-ring therebetween to define a constant closed air flow path from the aperture to the air outlet and the bimetallic element being flexibly movable from the maximum convex position throughout the predetermined temperature range to define a variable air flow path from at least one of the primary or secondary air inlets to the air outlet, whereby the rate of air flow to the choke thermostat varies as the temperature varies over the predetermined range.

8. In a carburetion system as defined in claim 7, wherein the preloading means includes a flexible member releasably retained by the housing and positioned on the bimetallic element so as to urge the bimetallic element towards the maximum convex position.

9. In a carburetion system as described in claim 7, wherein the preloading means includes projection means on the cap means extending into engagement with the bimetallic element so as to urge the bimetallic element towards the maximum convex position.

* * * * *